US007090055B1

(12) United States Patent
McLaughlin et al.

(10) Patent No.: US 7,090,055 B1
(45) Date of Patent: Aug. 15, 2006

(54) BOAT LIFT BRAKE APPARATUS

(75) Inventors: Shawn M. McLaughlin, Punta Gorda, FL (US); Riku Ylipelkonen, Ft. Myers, FL (US)

(73) Assignee: Quality Boat Lifts, Inc., Fort Myers, FL (US)

( * ) Notice: Subject to any disclaimer, the term of this patent is extended or adjusted under 35 U.S.C. 154(b) by 316 days.

(21) Appl. No.: 10/805,981

(22) Filed: Mar. 22, 2004

Related U.S. Application Data

(60) Provisional application No. 60/456,343, filed on Mar. 20, 2003.

(51) Int. Cl.
*B66B 1/32* (2006.01)

(52) U.S. Cl. ..... 187/288; 254/366; 254/375; 405/3

(58) Field of Classification Search ..... 187/288, 187/306, 351, 358, 363, 366, 373, 374, 207, 187/208; 212/284–290, 170–174, 247, 248, 212/115, 331; 254/347, 353, 362, 366, 369–376; 414/137.1, 564, 678; 405/3
See application file for complete search history.

(56) References Cited

U.S. PATENT DOCUMENTS 3,687,236 A * 8/1972 Caputo ..... 187/293
3,741,348 A * 6/1973 Caputo ..... 187/284
4,085,823 A * 4/1978 Caputo et al. ..... 187/293
4,278,393 A * 7/1981 Baron ..... 414/690
4,359,207 A * 11/1982 Maryonovich et al. ..... 254/272
4,496,063 A * 1/1985 Ishii et al. ..... 212/270
4,796,765 A * 1/1989 Mayne ..... 212/337
5,693,919 A * 12/1997 Sager et al. ..... 187/282

* cited by examiner

*Primary Examiner*—Jonathan Salata
(74) *Attorney, Agent, or Firm*—William E. Noonan

(57) ABSTRACT

A boat lift braking system includes a threaded shaft driven by the boat lift motor. A torsion tube disposed about the shaft carries an interiorly threaded nut that interengages the peripheral threads of the shaft. A rotor is mounted to the nut adjacent a brake pad that is supported by a ratchet component. A pawl mechanism cooperates with the ratchet component for limiting rotation of the ratchet component in a first direction and permitting rotation of the ratchet component about the shaft in a second direction. The torsion tube is connected through a reduction apparatus to the winder of the boat lift. When the lift is at rest, a torsion spring drives the torsion tube and rotor against the brake pad and the ratchet component interlocks with the pawl mechanism to hold the lift at a desired elevation. When the motor is driven to lower the lift, the shaft is driven within the torsion tube such that the rotor momentarily disengages the pad. Immediately thereafter, the torsion spring forces the rotor back against the pad and these counteracting forces continuously repeat to provide a controlled descent. When the motor is operated to raise the lift, the shaft is driven relative to the torsion tube such that the rotor and pad interlock. The ratchet component disengages the pawl and the torsion tube turns so that the lift can be elevated.

19 Claims, 7 Drawing Sheets

BOAT LIFT BRAKE APPARATUS

RELATED APPLICATION

This application claims the benefit of U.S. Provisional Application Ser. No. 60/456,343, filed Mar. 20, 2003.

FIELD OF THE INVENTION

This invention relates to a brake apparatus and, more particularly, to a brake specifically designed for use in a boat lift.

BACKGROUND OF THE INVENTION

Boat lifts require the use of an appropriate braking system in order to hold the raised or hoisted marine vessel in an elevated condition. The braking system also permits the boat lift operator to lower the vessel in a controlled manner. Without an appropriate brake, the boat would freefall whenever the lift motor is deactivated. Moreover, a controlled descent would be almost impossible to achieve.

Presently, the gear box provides the required braking for most boat lifts. More particularly, braking is typically accomplished through the worm gear of the drive motor, which both supports the load at rest and allows the load to descend in a controlled fashion. This is very energy inefficient. A significant portion of the motor's power must be diverted and used to brake the supported load. Even if little or no weight is supported by the lift, during descent the motor must overcome the inherent braking force of the motor. This draws significant power away from the drive motor. As a result, an excessively large capacity motor may be required. By the same token, the operating speed of the lift is slowed substantially.

SUMMARY OF THE INVENTION

It is therefore an object of this invention to provide a boat lift braking system, which does not require that braking be performed by the lift motor and which therefore operates more efficiently than existing brake systems.

It is a further object of this invention to provide a boat lift brake apparatus, which does not divert useful power from the motor to perform braking so that the motor operates more efficiently and less horsepower is required to perform particular lifting operations.

It is a further object of this invention to provide a boat lift braking system that enables the motor to operate the lift more rapidly than in systems wherein a significant portion of the motor output is diverted to perform braking.

It is a further object of this invention to provide a boat lift braking system that reduces the lift's power requirements and attendant costs.

It is a further object of this invention to provide a boat lift braking system that operates reliably and safely in a variety of lift environments.

This invention results from a realization that improved, efficient boat lift braking may be achieved by employing a braking system that does not rely largely upon the lift's gear box to perform braking, but which instead employs a unique one-way clutch and brake that hold the supported vessel at rest and allows for a controlled descent of the vessel as required.

This invention features a boat lift braking system including an axially rotatable shaft that is operably connected to the boat lift motor and selectively driven by the motor in a first direction when the motor is operated to lower the lift and an opposite second direction when the motor is operated to raise the lift. An elongate torsion tube is mounted on and disposed about the shaft. The shaft has an exterior thread and the tube carries a nut having a complementary internal thread that interengages the thread of the shaft. A one-way clutch featuring a ratchet is mounted rotatably on the shaft for carrying a braking pad. A rotor is mounted to the torsion tube in proximity to the braking pad. A torsion spring interconnecting the shaft and the tube urges the tube torsionally in a first direction such that the rotor is driven against the pad. A pawl device is pivotally supported by the lift such that it cooperates with the ratchet. When the rotor is driven against the pad by the torsion tube, the ratchet interengages and interlocks with the pawl such that further rotation of the ratchet is restricted. The torsion tube is operably connected through a reduction mechanism to the winder of the lift. When the ratchet is interlocked with the pawl and the rotor and pad are frictionally interengaged further rotation of the tube and resultant lowering of the lift are prevented.

To lower the lift, the shaft is rotated by the motor such that the outer threads of the shaft and the interior threads of the torsion tube cooperate to disengage the rotor momentarily from the pad. The torsion spring then biases the torsion tube to rotate axially and re-engage the rotor with the pad. This process continuously repeats so that downward acceleration of the lift is restricted. This, in turn, rotates the winder interconnected to the torsion tube such that the lift descends in a controlled manner. The ratchet remains interlocked with the pawl device.

When the motor and therefore the shaft are rotated in an opposite direction, the complementary threads of the threads and nut cooperate such that the rotor is driven against the pad. The ratchet is thereby rotated about the shaft to disengage the pawl. This releases the brake so that the winder may be rotated freely to elevate the lift.

In a preferred embodiment, the torsion tube includes a longitudinal slot that receives an outer end of the torsion spring. The opposite end of the torsion spring may be received in a channel or slot formed in the threaded shaft. A pair of torsion springs may be utilized to interconnect the shaft and the torsion tube.

An interiorly threaded nut or bushing may be interconnected to one end of the torsion tube. The interiorly threaded nut or bushing may be threadably interengaged with the outer threaded surface of the shaft. The rotor may be mounted to the interiorly threaded nut or bushing.

The pawl mechanism may include a finger element and a bearing member that is frictionally engagable with the ratchet for pivoting the finger element to selectively engage the ratchet while the lift is at rest or being lowered. The ratchet pivots the finger element to disengage the ratchet while the lift is being raised. A pawl spring biases the pawl so that the bearing member engages the ratchet.

DETAILED DESCRIPTION OF PREFERRED EMBODIMENTS

Other objects, features and advantages will occur from the following description of preferred embodiments and the accompanying drawings, in which.

Figure 1:
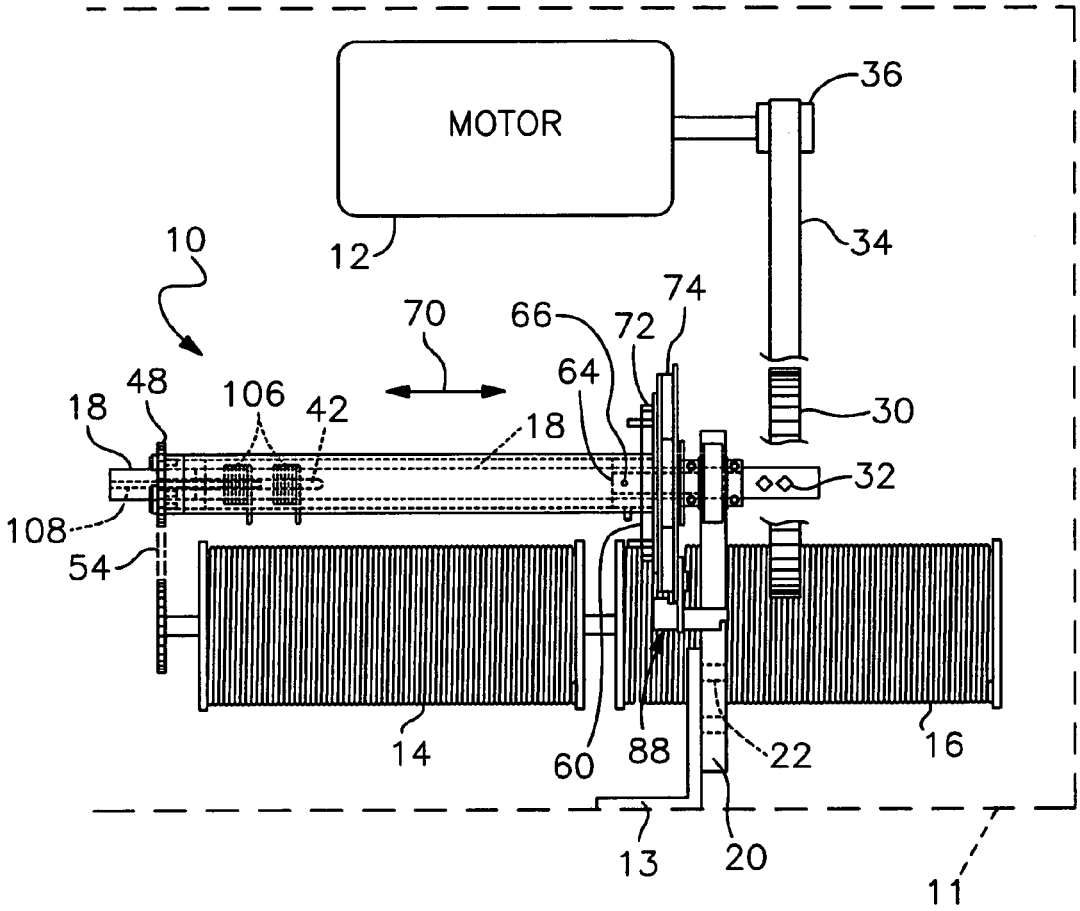
FIG. 1 is an elevational, partly schematic view of the brake apparatus of this invention operably mounted in the drive housing of a boat lift.

There is shown in FIGS. 1–5 a boat lift braking system 10. The braking system is particularly suitable for controlling braking in a marine or boat lift, certain components of which are depicted in FIG. 1 only. The braking system is typically used in connection with boat lifts featuring one or more motor driven winches or winders for selectively raising and lowering cables that support a lift platform. In FIG. 1 a boat lift motor 12 is shown schematically. The motor is operably connected in a known manner to axially aligned winches or winder drums 14 and 16. Connecting the motor to the winders is typically accomplished by gears, sprockets or other reduction means not shown specifically herein. A boat lift of the type generally shown in FIG. 1 is more specifically described in U.S. Pat. No. 6,230,639 and pending U.S. patent application Ser. No. 10/179,115 filed Jun. 25, 2002, the descriptions of which are incorporated herein by reference. It should be understood, however, that the use of the braking system of this invention is not limited to precisely these types of marine lifts. The braking system may be used in connection with virtually all other types of motor driven, cable lifting systems. Indeed, the brake may be employed for various lifts and hoists employed outside of the marine industry. The details of such lifts will be known to persons skilled in the art. In these types of systems, when the motor 12 is driven in a first direction, a winder (in this case comprising drums 14 and 16) operates to deploy one or more lifting cables, which in turn lower the load or lift platform. When the motor is driven in an opposite direction, the cable or cables are retracted onto the winder assembly and the platform or load is lifted.

As shown in FIGS. 1–6, braking system 10 includes an elongate threaded shaft 18 that is mounted to the housing 11 of the brake lift drive by means of a support element 20. More particularly, support element 20 includes a generally flat plate that is attached to the housing of the boat lift drive by means of bolts (not shown) that interengage a mounting bracket 13 and holes 22 in support plate 20. It should be understood that support plate 20 may be secured at various locations and in various ways within the housing or mounting assembly of the boat lift drive. As best shown in FIG. 1, it is often convenient to mount the support plate somewhat beneath motor 12 and adjacent to winder drums 14 and 16.

Figure 2:
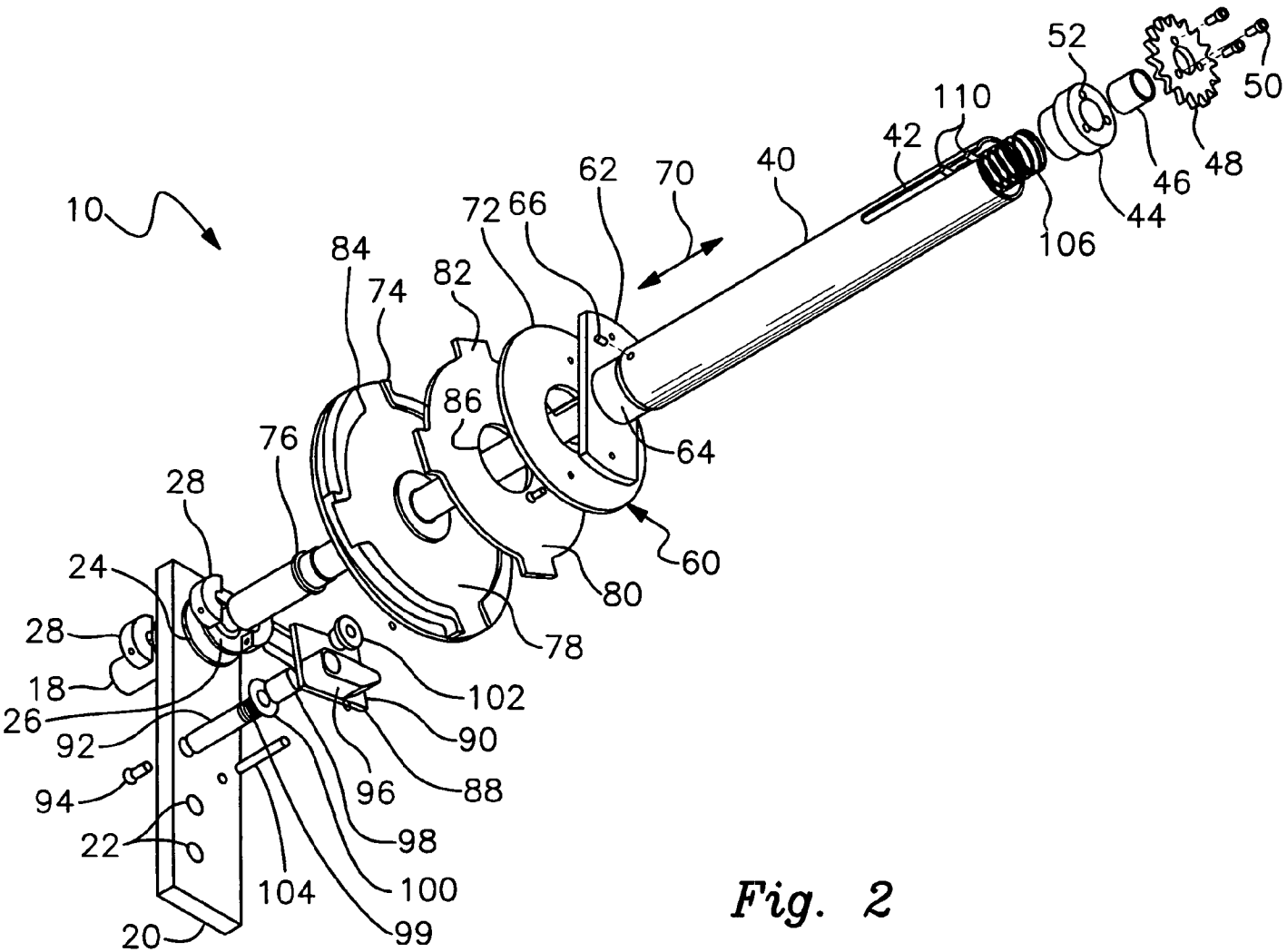
FIG. 2 is an exploded view of the boat lift braking system.
Figure 7:
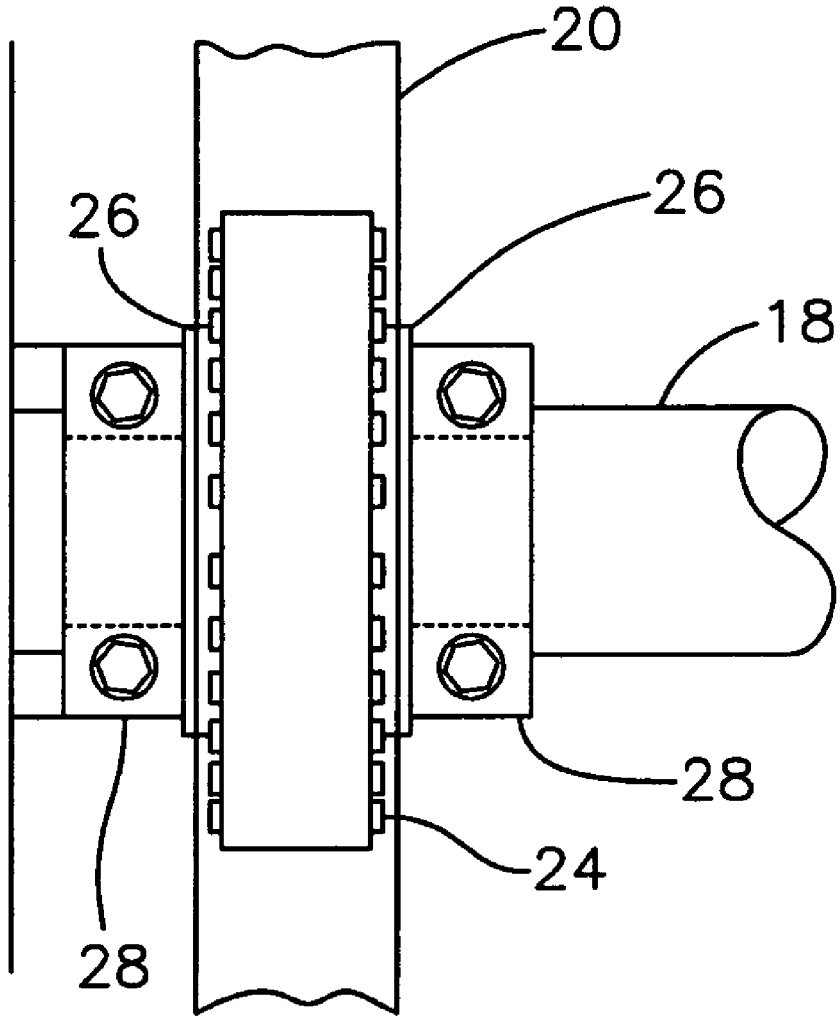
FIG. 7 is an elevational view of the mounting collar by which the drive shaft of the brake is mounted to a support element of the boat lift.

The upper end of support plate 20 includes an opening that supports a bearing 24, best shown in FIGS. 2 and 7. Threaded shaft 18 extends through and is rotatably supported by bearing 24. A pair of nylon washers 26 are disposed about the shaft on respective sides of the bearing 24. Two piece shaft collars 28 are mounted on the shaft respectively outside of washers 26. These collars prevent the threaded shaft from moving longitudinally relative to support plate 20. The foregoing structure supports the threaded shaft such that it is axially rotatable relative to the support plate within bearing 24. Preferably, the opposite end of shaft 18 is rotatably mounted at its opposite end in a manner analogous to that described above. Such support is omitted for clarity herein.

Shaft 18 is operably interconnected to motor 12 in the following manner. A circular sprocket 30, which is depicted in cut-away fashion in FIG. 1, is attached fixedly to shaft 18 by bolts or other means of connection. For example, sprocket 30 may be fastened to shaft 18 by interconnecting bolts, screws or other means of attachment through the sprocket and through complementary holes 32 in the shaft. A toothed belt 34 operably connects sprocket 30 to the drive pulley 36 of motor 12. It should be understood that various types of gears, pulleys and sprockets may be substituted for sprocket 30 and pulley 36. In any case, when motor 12 is operated, belt 34 (which may alternatively comprise a chain or other drive means) is operated to rotatably drive sprocket 30. This in turn axially rotates shaft 18 such that the braking system is operated in the manner described below.

An elongate cylindrical torsion tube 40 is mounted on and disposed about shaft 18. Tube 40 includes a longitudinal slot 42 that extends inwardly from one end of the tube. That end of the torsion tube receives a hub component 44 that is welded or otherwise permanently secured to the end of tube 40. A sleeve bearing 46 is received within the central opening of hub 40 and threaded shaft 18 extends through the sleeve bearing such that the threaded shaft may be rotated axially within torsion tube 40. A sprocket 48 is fixedly secured to hub 44 by screws 50 that are interengaged with complementary holes 52 in hub 44. A chain 54, shown schematically in FIG. 1, is operably interconnected to the winders 14 and 16 through appropriate and conventional reduction means, not described specifically herein. In alternative embodiments, a pulley or similar means may be substituted for sprocket 48. Belts and alternative drive means may be substituted for chain 54. Normally, shaft 18 will be rotatably supported within the housing by a support plate located exteriorly of sprocket 48 along shaft 18.

Figure 6:
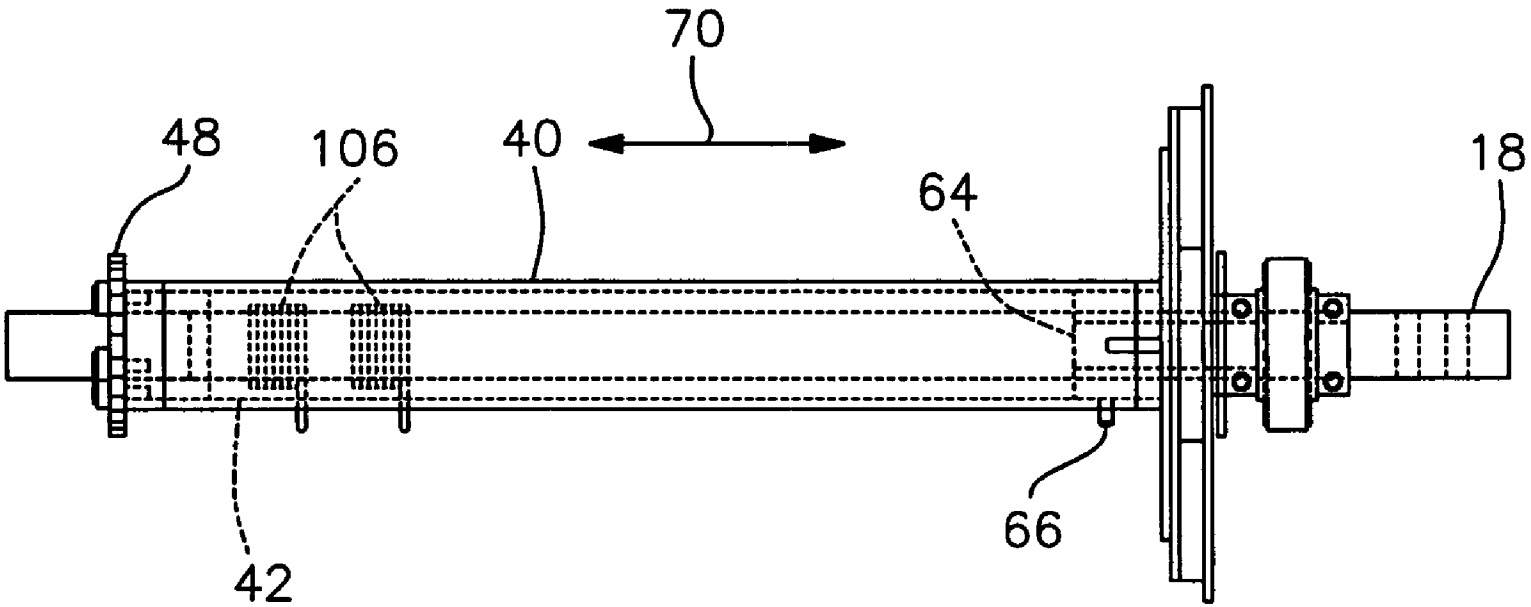
FIG. 6 is a top view of the braking system.

The opposite end of tube 40 carries a rotor assembly 60. More particularly, the rotor assembly includes a rotor support bar 62 that is fixed to the end of tube 40 by an integral bushing or nut 64. This nut is welded or otherwise permanently secured to the rotor support bar 62 and is received within torsion tube 40, as best shown in FIGS. 1 and 6. A set screw 66 secures the nut 64 within tube 40. Nut 64 has interior threads that operably interengage the acme threads of shaft 18. As a result, the torsion tube 40 is threadably adjustable along shaft 18. Tube 40 is able to move slightly along shaft 18 in the opposing directions indicated by double-headed arrow 70.

A rotor disc 72 is secured to rotor support bar 62 by means such as screws or bolts (not shown) that interengage complementary holes in the rotor-mounting member and the rotor disc. As a result, rotor disc 72 is fixedly attached to the distal end of torsion tube 40. Rotor disc 72 is axially rotatable about shaft 18.

A generally annular ratchet component 74 is mounted loosely on shaft 18, which extends through a central opening of the ratchet component. More particularly, ratchet 74 sits upon a flanged bearing 76 that is disposed about the threaded shaft. The ratchet component includes a keyed opening 78, FIG. 2, which receives a correspondingly shaped brake pad 80. The brake pad includes a plurality of peripheral arms or projections 82 that fit within correspondingly shaped recesses 84 in ratchet component 74. As a result, the brake pad is fixed relative to and does not rotate within the ratchet component. Pad 82 includes a central opening 86 that is aligned with respective central openings in the ratchet component and the rotor disc 72 for receiving threaded shaft 18. The ratchet component is configured to include a plurality of stops or teeth, which operate to provide braking in a manner described more fully below.

A pawl mechanism 88 cooperates with ratchet component 74. In particular, pawl mechanism 88 features a bracket 90 that is pivotally mounted to support member 20. A dowel 92, FIG. 2, is received through a hole in plate 20 and secured thereto by a screw 94. Bracket 90 of pawl mechanism 88 includes a finger or detent 96 that interengages a bearing 98 such that the pawl mechanism is pivotable about dowel 92. A washer 100 is disposed between the inner end of bearing 98 and support plate 20. A flanged friction bearing 102 is also carried by the outer surface of pawl bracket 90. A spring 99 urges this friction bearing to interengage the inside surface (not shown) of ratchet component 74 when the brake apparatus is fully assembled. A spring pin 104 is mounted to support plate 20 for limiting the downward or outward pivoting of pawl mechanism 88.

A pair of axially aligned, helical torsion springs 106 interconnect threaded shaft 18 and torsion tube 40. The inside end of each spring 106 is received within a longitudinal slot 108 formed in shaft 18. The slot typically extends only partly along the length of the shaft. The outer end 110 of each spring is received through the longitudinal slot 42 extending from one end of torsion tube 40. As a result, each of the springs 106 is interconnected between shaft 18 and tube 40.

Springs 106 are biased such that they load the torsion tube and the brake apparatus is the following manner. Specifically, springs 106 bias tube 40 relative to shaft 18, as indicated by arrow B in FIG. 3. This turns the interior threads of nut 64 relative to the exterior threads of shaft 18 so that torsion tube 40 drives rotor disc 72 against brake pad 80. This spring bias provides the basis of the braking operation of apparatus 10.

During operation of the boat lift, braking is normally required when the lift is at rest in an elevated condition and also during descent. The operator must avoid freefall of the supported load and achieve a controlled descent when required. The present invention accomplishes these objectives.

When the lift is at rest, with the platform in an elevated condition, brake apparatus 10 maintains the platform in the raised position without exerting undue braking strain upon motor 12. In this state, the motor ceases operation. As a result, threaded shaft 28 remains stationary. As previously described, springs 106 bias torsion tube 40 in the direction of arrow B. This drives the attached nut 64 threadably along the shaft and rotor assembly 60 is urged against the brake pad 80 supported by ratchet component 74. The ratchet component, which is mounted freely on the shaft, turns and its outer surface engages pawl bearing 102. This causes the pawl mechanism to pivot about dowel 92 so that finger 96 of pawl mechanism 88 interengages a stop or tooth of ratchet component 74. This locks the ratchet in place. As a result, the rotor and integrally attached torsion tube are locked in place and prevented from axially rotating. This prevents sprocket 48 and interengaged chain/belt 54 from operating. Winder drums 14 and 16, which are connected to the brake apparatus through chain/belt 54 are likewise locked in place and the boat lift platform is effectively braked. The weight or load supported by the lift cables continues to urge the torsion tube and attached rotor assembly against the friction brake pad and consequently maintains the ratchet component in an interlocking relationship with the pawl mechanism. Neither the rotor, torsion tube, sprocket, chain/belt or either winder drum is able to turn. Extremely safe and secure braking is thereby maintained.

To lower the lift, the motor is operated such that its motion is transmitted through belt 34 to sprocket 30 and shaft 18. As a result, the threaded shaft is driven in the direction of arrow 120, FIG. 3. This axial rotation causes the nut 64 to loosen relative to the threaded shaft 18. Torsion tube 40 and attached rotor assembly 60 "back off" and momentarily disengage brake pad 80, as indicated by arrow 122 in FIG. 3. Such disengagement is slight, but it enables the torsion tube and its attached sprocket 48 to rotate. This permits the interconnected winders to rotate and unwind so that the load supported by the lift cables is lowered. At the same time, the bias of springs 106 and the weight of the descending load exert torque on the torsion tube, which pushes the tube and its attached rotor back against the brake pad. This cycle then continuously repeats itself in small increments so that the load is lowered but at the same time, frictional engagement between the rotor and the pad and resultant controlled braking and descent are maintained. The lift is restricted from accelerating downwardly. This is again accomplished without unduly diverting and utilizing the power of the motor to effect braking. Significant horsepower is saved. As a result, a smaller capacity and far less costly motor may be utilized in the lift. During descent, the pawl mechanism remains engaged and locked with ratchet component 74.

The opposing torsional forces exerted on the braking system effectively achieve the controlled descent. Specifically, motor 12 attempts to rotate shaft 18 in one direction relative to torsion tube 40. This causes the rotor disc to separate from the pad. The tendency of the load to freefall and the force of springs 106 then cause the torsion tube to overcome the rotational force of the motor. This counteracting force drives the rotor in a direction opposite to the direction in which the shaft is turning. As a result, the rotor is driven back into the brake pad and controlled braking is maintained. An automatic self-adjusting system is achieved. The same degree of controlled descent is provided regardless of the weight of the boat or other vessel supported by the lift. The torsion springs 106 compensate for various load weights. It should also be understood that the preloaded bias of the springs may be readily adjusted by substituting alternative springs to provide desired braking characteristics. In any case, the pawl mechanism remains engaged with the ratchet during descent so that the ratchet component is prevented from rotating on the shaft. It should also be understood that in certain versions of this invention, a single torsion spring or more than two springs may be employed.

Figure 3:
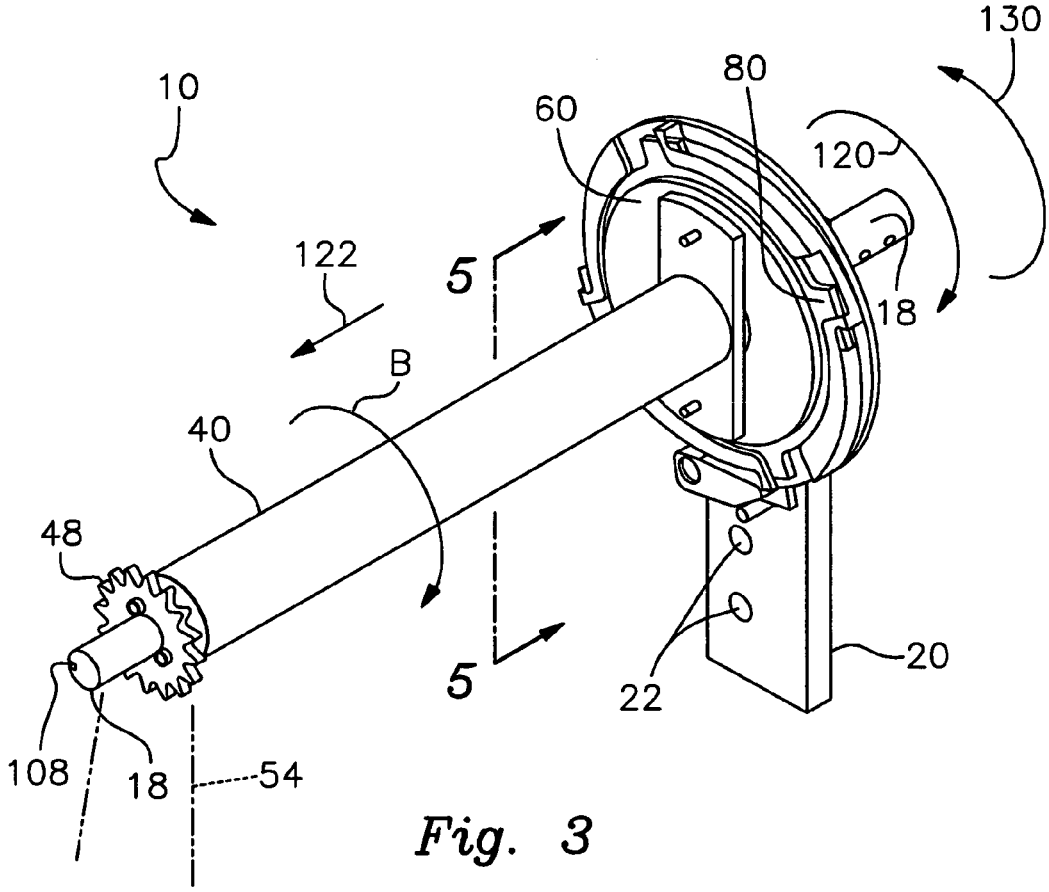
FIG. 3 is an upper perspective view of the braking system in an assembled condition.
Figure 4:
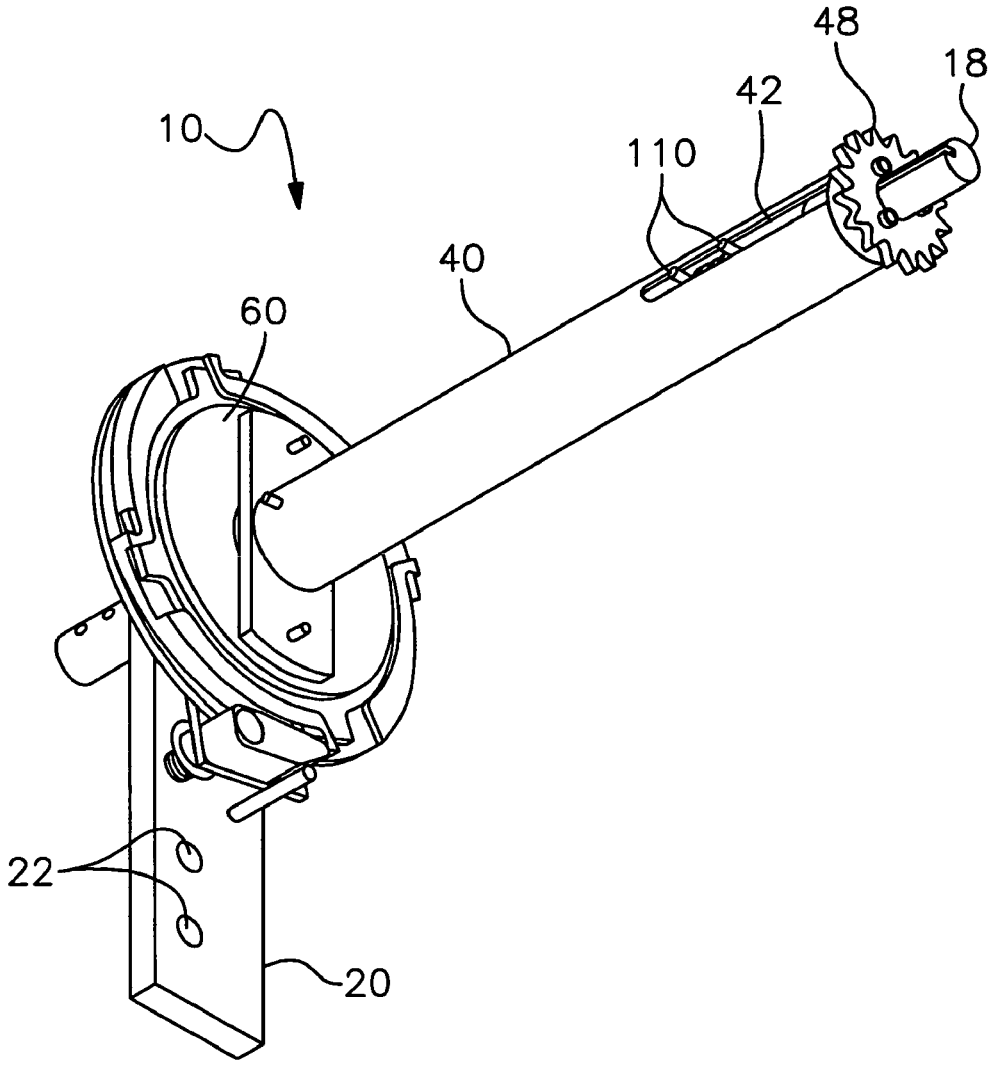
FIG. 4 is a lower perspective view of the assembled braking system specifically depicting a side of the torsion tube opposite the side shown in FIG. 3.
Figure 5:
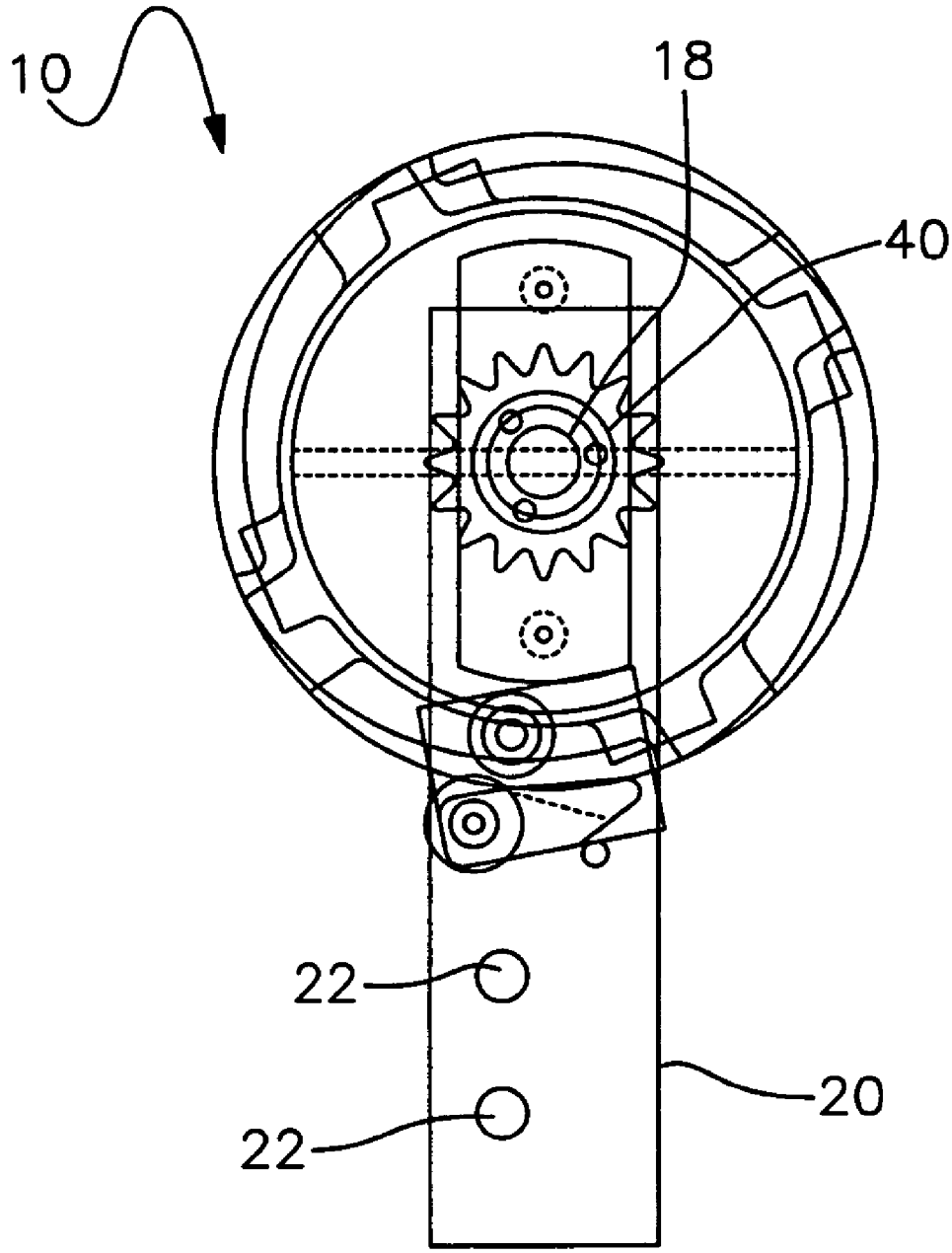
FIG. 5 is a cross sectional view taken along line 5—5 of FIG. 3.

To raise the lift, motor 12 is operated in an opposite direction such that shaft 18 is driven in the direction of arrow 130, FIG. 3. The threaded shaft is turned through the interior threads of nut 64 such that torsion tube 40 rotatably drives rotor assembly 60 into locking engagement with brake pad 80. As the shaft continues to rotate, ratchet component 74, which is effectively locked against the rotor, likewise turns in the direction of arrow 130, FIG. 3. This causes the teeth of the ratchet component to disengage the pawl mechanism 88. The outer surface of component 74 engages bearing 102 and causes the pawl mechanism to pivot such that finger 96 of pawl mechanism 88 disengages the locking tooth of ratchet component 74 and the ratchet component effectively freewheels rotationally about the turning shaft 18. The finger of pawl mechanism 88 passes relatively silently over the rotating ratchet component (i.e. the one-way clutch is disengaged). Torsion tube 40 and shaft 18 continue to rotate as the motor turns and, as a result, the winder drums, which are interconnected through chain/belt 54 and sprocket 48, are allowed to turn and raise the load. The motion of the shaft maintains the rotor tightly against the pad by itself, separately and apart from the force of torsion springs 106. When the lift attains a desired level of elevation, the motor is shut off. Brake system 10 then maintains the load at the selected elevation in the manner previously described.

The braking system significantly improves the capacity of winder and cable driven boat lifts. The motor is allowed to operate at an optimal speed, capacity and efficiency without having to do unnecessary work and without sacrificing significant power during descent in order to combat and limit freefall. This improvement in efficiency allows most lifts to operate effectively with smaller capacity motors. Increased speed is also accomplished. For example, conventional ten thousand pound boat lifts typically require two ¾ horsepower motors to operate effectively. By utilizing the braking system of this invention, comparable operation is achieved in such lifts by utilizing a single 1 horsepower motor. Whereas a speed of twenty-two inches per minute is exhibited in the conventional ten thousand pound lift, an improved speed of thirty two inches per minute is provided in a comparable lift employing the braking system and a single 1 horsepower motor in accordance with this invention. These examples are for illustration only and are not intended to limit the scope of the invention. The braking system therefore significantly improves the efficiency and reduces the cost of most cable driven boat lifts. As previously stated, the braking system is automatically self adjustable so that the same type of safe and effective braking is provide regardless of the weight of the vessel or total load supported by the lift.

The components of the braking system may be constructed of durable metals, metal alloys and, where appropriate, high strength plastics. It should be understood that various types of alternative one-way clutch mechanisms may be substituted for the ratchet and pawl assembly disclosed herein.

While this detailed description has set forth particularly preferred embodiments of the apparatus of this invention, numerous modifications and variations of the structure of this invention, all within the scope of the invention, will readily occur to those skilled in the art. Accordingly, it is understood that this description is illustrative only of the principles of the invention and is not limitative thereof.

Although specific features of the invention are shown in some of the drawings and not others, this is for convenience only, as each feature may be combined with any and all of the other features in accordance with this invention.

What is claimed is:

1. A lift braking system comprising:

a winder having a load supporting cable wound thereon;

a threaded shaft;

a torsion tube disposed about and threadably interengaged with said shaft such that said tube is moved longitudinally relative to said shaft when said tube is turned axially about said shaft; said tube being operably connected to said winder such that axial rotation is transmitted between said tube and said winder; said tube carrying a first brake component;

a rotatable ratchet for supporting a complementary second brake component adjacent said first brake component;

a pawl that cooperates with said ratchet for restricting rotation of said ratchet in a first direction and allowing rotation of said ratchet in an opposite second direction; and a motor for axially rotatably driving said shaft selectively in opposing directions for respectively raising and lowering the load; said tube being responsive to the load supported by the winder and deactivation of said motor for turning axially on said shaft to interengage said brake components and interlock said ratchet with said pawl, whereby rotation of said tube and said winder are restricted and the lift is held at a selected elevation; said motor operating in a first direction to turn said tube axially relative to said shaft such that said brake components are momentarily disengaged and said tube and winder allow the load to be lowered by the cable, said tube thereafter being responsive to the supported load for turning on said shaft and re-engaging the brake components so that rotation of the tube and winder and lowering of the lift are controlled; said motor operating in an opposite, second direction to turn said tube axially relative to said shaft such that said brake components are interengaged and said ratchet component disengages and rotates freely of said pawl, whereby said tube and winder rotate to wind cable onto said winder and elevate the lift.

2. The system of claim 1 in which said tube is driven alternately in opposing directions along said shaft to alternately disengage and re-engage said brake components when said motor is operating in the first direction.

3. The system of claim 1 further including a torsion spring interconnecting said shaft and said tube for urging said tube to turn axially relative to said shaft such that said first and second brake components are interengaged and for allowing said tube to turn intermittently in the opposite direction on said shaft when said motor is operating in said first direction.

4. The system of claim 1 in which said first and second brake components comprise a brake rotor and a brake pad, respectively.

5. The system of claim 3 in which said torsion tube includes a longitudinal slot that receives an outer end of the spring.

6. The system of claim 3 in which said spring is a coil spring wound about said shaft and within said tube.

7. The system of claim 3 in which an inner end of said spring is received in a channel in said shaft.

8. The system of claim 3 further including a second torsion spring interconnecting said shaft and said tube for urging said tube to turn on said shaft such that said brake components interengage.

9. The system of claim 1 further including an interiorly threaded nut element mounted within said tube for threadably interconnecting said tube and said threaded shaft.

10. The system of claim 9 in which said first brake component is mounted to said interiorly threaded nut.

11. The system of claim 1 in which said pawl includes a pivotable finger element and a bearing member that is frictionally engagable with said ratchet for pivoting the finger element to selectively engage the ratchet while the motor is deactivated or turning in the first direction.

12. The system of claim 11 in which said ratchet pivots said finger to disengage said ratchet when the motor is operating in the second direction.

13. The system of claim 11 further including a pawl spring for biasing said pawl so that said bearing member engages the ratchet.

14. The system of claim 1 in which said ratchet is mounted rotatably on said shaft.

15. The system of claim 1 in which said tube is operably connected to said winder through a reduction mechanism.

16. A braking system for a motor driven lift, which lift includes a winder having a load supporting lifting cable wound thereon, said braking system comprising:

a axially rotatable, threaded shaft operably connectable to the lift motor for being selectively driven by the motor in a first direction when the motor is operated to lower the lift and in an opposite second direction when the motor is operated to raise the lift;

a torsion tube mounted on and disposed about said shaft; said tube threadably interengaged with said shaft such that said tube is moved longitudinally relative to said shaft when said tube is turned axially about said shaft; said tube being operably interconnectable to the winder through a reduction mechanism such that axial rotation is transmittable between said tube and the winder;

a brake rotor attached to said tube and rotatable about said shaft;

a ratchet component mounted rotatably on said shaft and supporting a brake pad adjacent said brake rotor;

a pawl for cooperating with said ratchet to limit rotation of said ratchet in a first direction about said shaft and permitting rotation of said ratchet in an opposite second direction about said shaft; and a torsion spring that interconnects said shaft and said tube for urging said tube to turn axially on said shaft such that said brake rotor interengages said brake pad and said ratchet component and said pawl interlock to hold the lift at a predetermined elevation when the motor is deactivated;

said shaft being driven axially rotatably by the motor in one direction to turn said torsion relative to said shaft such that said brake rotor is momentarily disengaged from said brake pad, said tube during said momentary disengagement being responsive to at least one of said torsion spring and the supported load for turning on said shaft to re-engage said first brake component with said second brake component so that rotation of the winder and lowering of the lift are controlled;

said shaft being driven axially rotatably by the motor in the opposite direction to turn said tube axially on said shaft such that said rotor interengages said pad and said ratchet disengages and rotates freely of said pawl, whereby said tube rotates the winder to elevate the lift.

17. The system of claim 16 in which said tube is driven alternately in opposing directions along said shaft to alternately disengage and re-engage said brake components when said motor is operating in the first direction.

18. The system of claim 16 in which said spring is a coil spring wound about said shaft and within said tube.

19. The system of claim 16 in which said pawl includes a pivotable finger element and a bearing member that is frictionally engagable with said ratchet for pivoting the finger element to selectively engage the ratchet while the motor is deactivated or turning in the first direction.

* * * * *